US007260335B2

(12) United States Patent
Kato et al.

(10) Patent No.: US 7,260,335 B2
(45) Date of Patent: Aug. 21, 2007

(54) IMAGE-INFORMATION DETECTING DEVICE AND IMAGE FORMING APPARATUS

(75) Inventors: Shinji Kato, Kanagawa (JP); Yushi Hirayama, Tokyo (JP); Shin Hasegawa, Chiba (JP); Hitoshi Ishibashi, Kanagawa (JP); Kohta Fujimori, Kanagawa (JP); Naoto Watanabe, Chiba (JP); Kayoko Tanaka, Chiba (JP); Takashi Enami, Kanagawa (JP); Shinji Kobayashi, Kanagawa (JP); Kazumi Kobayashi, Tokyo (JP); Fukutoshi Uchida, Kanagawa (JP); Noboru Sawayama, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 196 days.

(21) Appl. No.: 11/192,045

(22) Filed: Jul. 29, 2005

(65) Prior Publication Data

US 2006/0024076 A1 Feb. 2, 2006

(30) Foreign Application Priority Data

Jul. 30, 2004 (JP) ..... 2004-223935
Aug. 4, 2004 (JP) ..... 2004-228436

(51) Int. Cl.
*G03G 15/16* (2006.01)

(52) U.S. Cl. ..... 399/49; 399/66; 399/313

(58) Field of Classification Search ..... 399/49, 399/66, 297, 299, 302, 313
See application file for complete search history.

(56) References Cited

U.S. PATENT DOCUMENTS 5,182,600 A 1/1993 Hasegawa et al.
5,198,861 A 3/1993 Hasegawa et al.
5,227,842 A 7/1993 Hayashi et al.
5,237,369 A 8/1993 Maruta et al.
5,270,783 A 12/1993 Bisaiji et al.
5,293,198 A 3/1994 Sawayama et al.
5,298,944 A 3/1994 Sawayama et al.
5,327,196 A 7/1994 Kato et al.
5,387,965 A 2/1995 Hasegawa et al.
5,424,809 A 6/1995 Sawayama et al.
5,475,476 A 12/1995 Murai et al.

(Continued)

FOREIGN PATENT DOCUMENTS

JP 7-253729 10/1995

(Continued)

*Primary Examiner*—Hoang Ngo
(74) *Attorney, Agent, or Firm*—Oblon, Spivak, McClelland, Maier & Neustadt, P.C.

(57) ABSTRACT

A device for detecting image information includes an intermediate transfer member configured to hold a pattern image; a detecting unit configured to optically detect the pattern image; a secondary transfer unit configured to contact with and separate from the intermediate transfer member; and a control unit that controls the secondary transfer unit in such a manner that the secondary transfer unit does not contact the intermediate transfer member while the detecting unit is detecting the pattern image, and that controls the secondary transfer unit in such a manner that the secondary transfer unit contacts the intermediate transfer member after the detecting unit finishes detection of the pattern image.

19 Claims, 15 Drawing Sheets

U.S. PATENT DOCUMENTS

| | | | | |
|---|---|---|---|---|
| 5,627,649 | A | 5/1997 | Sawayama et al. | |
| 5,630,195 | A | 5/1997 | Sawayama et al. | |
| 5,682,572 | A | 10/1997 | Murai et al. | |
| 5,729,353 | A | 3/1998 | Sawayama et al. | |
| 5,761,570 | A | 6/1998 | Sawayama et al. | |
| 5,857,131 | A | 1/1999 | Hasegawa | |
| 5,860,038 | A | 1/1999 | Kato et al. | |
| 5,970,276 | A | 10/1999 | Kato | |
| 6,055,386 | A | 4/2000 | Kato et al. | |
| 6,125,257 | A | 9/2000 | Sekine et al. | |
| 6,160,569 | A | 12/2000 | Fujimori et al. | |
| 6,496,677 | B2 | 12/2002 | Fujimori | |
| 6,526,235 | B2 | 2/2003 | Kato | |
| 6,529,695 | B2 * | 3/2003 | Katayanagi et al. | 399/49 |
| 6,591,077 | B2 | 7/2003 | Yanagisawa et al. | |
| 6,594,453 | B2 | 7/2003 | Kato | |
| 7,085,524 | B2 * | 8/2006 | Soda et al. | 399/302 |
| 2004/0009015 | A1 | 1/2004 | Fujimori et al. | |
| 2004/0136760 | A1 | 7/2004 | Yoshida et al. | |
| 2004/0251435 | A1 | 12/2004 | Sawayama et al. | |
| 2004/0253012 | A1 | 12/2004 | Ishibashi | |
| 2005/0019048 | A1 | 1/2005 | Kato | |

FOREIGN PATENT DOCUMENTS

| | | |
|---|---|---|
| JP | 10-20616 | 1/1998 |
| JP | 10-161388 | 6/1998 |
| JP | 11-119480 | 4/1999 |
| JP | 2000-321838 | 11/2000 |
| JP | 2002-123052 | 4/2002 |
| JP | 2003-76109 | 3/2003 |
| JP | 2003-98932 | 4/2003 |
| JP | 2003-167394 | 6/2003 |
| JP | 3458579 | 8/2003 |

* cited by examiner

IMAGE-INFORMATION DETECTING DEVICE AND IMAGE FORMING APPARATUS

CROSS-REFERENCE TO RELATED APPLICATIONS

The present document incorporates by reference the entire contents of Japanese priority documents, 2004-223935 filed in Japan on Jul. 30, 2004 and 2004-228436 filed in Japan on Aug. 4, 2004.

BACKGROUND OF THE INVENTION

1. Field of the Invention

The present invention relates to a technology for detecting image information from pattern images in an image forming apparatus.

2. Description of the Related Art

In an image forming apparatus such as a copier, a facsimile machine, a printer, or a printing machine, a visual image carried on a photosensitive element is transferred to a transfer member.

A recording sheet that directly contacts the photosensitive element or a belt-type transfer member is used as the transfer member. The belt-type transfer member is used to form a multi-color image.

To form a multi-color image, the image forming apparatus employs photosensitive elements. On each of the photosensitive elements, a latent image of a different color is formed. A belt facing the photosensitive elements is rotated. The belt functions as an intermediate transfer member or a conveying member that caries a recording sheet on a surface (refer to Japanese Patent Application Laid Open No. H10-161388).

When the belt is used as the intermediate transfer member, each image formed on each photosensitive element is sequentially transferred and superposed onto the intermediate transfer member, by a primary transfer process. The superposed image is then transferred to a recording sheet by a secondary transfer process. When the belt is used as the conveying member, a recording sheet is carried on the surface of the belt facing the photosensitive element. As the belt rotates, images formed on each photosensitive element are sequentially superposed on the recording sheet.

In an image forming apparatus used for forming multi-color images, image quality, such as color reproducibility, needs to be stabilized. There is a method of stabilizing image quality by forming pattern images to detect image density, as disclosed in Japanese Patent Application Laid Open No. H10-161388.

Specifically, pattern images are formed on the photosensitive element or the intermediate transfer belt, and the pattern images are optically read. Based on results obtained by reading the pattern images, a feedback control is performed to control various parameters of image forming conditions.

The feedback control is performed as follows. An image-density detecting sensor detects an amount of toner adhering to a pattern image formed on the intermediate transfer belt. When the amount does not satisfy a predetermined condition, various parameters are controlled to satisfy the condition. The parameters include a writing output property, a charging property of the photosensitive element, a charging property that affects adherence of the toner in a developer, and a developing bias property that controls the amount of toner adherence.

The pattern images formed on the intermediate transfer belt are larger than a detection area detected by the image-density detecting sensor. Density of a pattern image that covers the entire detection area is measured. Based on the detected density, the amount of toner adherence is calculated. The calculated amount is used to determine whether the predetermined condition is satisfied.

The pattern images are formed in an area other than a regular area in which a regular image is formed so as not to overlap a starting end of the regular area in which a next regular image is to be formed. A secondary transfer device is separated from the intermediate transfer belt while density of the pattern images is detected (refer to Japanese Patent Application Laid Open No. 2000-123052).

Moreover, an optical senor facing the intermediate transfer belt at a portion stretched out in a circumferential direction is used to detect the density (refer to Japanese Patent Application Laid Open No. 2002-123052, Japanese Patent Application Laid Open No. 2003-167394).

In the conventional technology, as disclosed in Japanese Patent Application Laid Open No. H9-204108, the detecting sensor is provided at a downstream side of a primary transfer position of the intermediate transfer belt and an upstream side of a secondary transfer position. However, this layout is disadvantageous in that the detecting sensor faces upward and toner scatters on to the detecting sensor. Moreover, because a sufficient distance is required between the primary transfer position and the secondary transfer position, it is difficult to reduce a size of the image forming apparatus, and to reduce time required to complete print of the first page.

On the other hand, if the detecting sensor is provided at a downstream side of the secondary transfer position, a secondary transfer roller needs to be applied with a bias of the same polarity as that of the toner when the image patterns pass through the secondary transfer position, as disclosed in Japanese Patent Application Laid Open No. H7-253729. However, it is impossible to completely prevent the toner from transferring to the secondary transfer roller. Moreover, an amount of the toner transferring to the secondary transfer roller is affected by the environment. Thus, the toner soils the surface of the secondary transfer roller, and the soiled secondary transfer roller soils a rear surface of a sheet of transfer paper. Moreover, irregularities in pattern images might be caused, resulting in inaccurate detection of the image density. One approach is to separate the secondary transfer roller from the intermediate transfer member. However, when the pattern image is created in between regular images being printed out continuously, such an action of attachment and detachment of the secondary transfer roller causes undesired variations in rotation of the intermediate transfer member. This has a detrimental affect on the images.

Another approach is to use a non-contact-type secondary-transfer device such as corotron. However, this increases ozone emission, and is disadvantageous in terms of conveyability of transfer paper.

In a technology disclosed in Japanese Patent Application Laid Open No. 2002-123052, the secondary transfer roller contacts with and separates from the intermediate transfer belt for detecting the pattern images. Accordingly, extra time is required to be provided for such movement. This requires larger intervals between recording sheets being conveyed on the intermediate transfer belt. As a result, image processing takes longer time.

Moreover, an impact of the secondary transfer roller due to such movement causes the intermediate transfer belt to shake. This affects an optical distance between the pattern images and the detecting sensor, resulting in detection errors. To overcome this problem, formation of pattern images is delayed from when regular images are formed, as shown in FIG. 16. The image forming process for regular images is suspended, and the secondary transfer roller separates from the intermediate transfer belt, before density of the pattern images is detected. In this manner, the detection process is unaffected by the shaking of the intermediate transfer belt. However, it takes a significantly long time for suspending and resuming the image forming process. If the optical sensor is positioned facing the portion of the intermediate transfer belt stretched out in the circumferential direction (refer to Japanese Patent Application Laid Open No. 2002-123052 and Japanese Patent Application Laid Open No. 2003-167394), the impact of the shake of the secondary transfer roller is particularly large.

A cleaning device can be provided to remove toner adhering to the secondary transfer roller after the secondary transfer process. However, the cleaning device is not provided when space and costs need to be saved. When the cleaning device is not provided, the above-described contacting/separating mechanism is required. However, usually, no means for solving problems caused by the shaking of the intermediate transfer belt is provided.

Pattern images are formed to provide image information on each color. Therefore, all pattern images need to be formed on the intermediate transfer belt before the secondary transfer process begins. However, when the secondary transfer process is brought forward in order to save time, a pattern image of a last color might not yet be formed. Thus, depending on timing in starting the secondary transfer process, the pattern images cannot be properly formed.

When performing the feedback control in an image forming apparatus including more than one image forming unit and the intermediate transfer member, pattern images with different amounts of toner adherence are formed by changing image forming conditions. It is difficult to perform a regular image forming operation during the feedback control. Thus, copying and printing operations need to be suspended while the feedback control is performed.

The time of the feedback control needs to be minimized to reduce a downtime during which copying and printing operations are suspended.

SUMMARY OF THE INVENTION

It is an object of the present invention to at least solve the problems in the conventional technology.

A device for detecting image information according to one aspect of the present invention includes an intermediate transfer member configured to hold a pattern image; a detecting unit configured to optically detect the pattern image; a secondary transfer unit configured to contact with and separate from the intermediate transfer member; and a control unit that controls the secondary transfer unit in such a manner that the secondary transfer unit does not contact the intermediate transfer member while the detecting unit is detecting the pattern image, and that controls the secondary transfer unit in such a manner that the secondary transfer unit contacts the intermediate transfer member after the detecting unit finishes detection of the pattern image.

An image forming apparatus according to another aspect of the present invention includes a device for detecting image information according to the above aspect.

An image forming apparatus according to still another aspect of the present invention includes an intermediate transfer member configured to hold a toner image and a pattern image; a secondary transfer unit configured to contact with and separate from the intermediate transfer member; a detecting unit configured to optically detect an amount of toner adhering to the pattern image to obtain a value, the detecting unit arranged downstream of rotation of the intermediate transfer member to the secondary transfer unit, the pattern image formed in a region in which a regular image is not formed; and a control unit that controls any one of an image forming condition and an amount of toner to be replenished depending on the value. The control unit further controls separating timing at which the secondary transfer unit separates from the intermediate transfer member and contacting timing at which the secondary transfer unit contacts with the intermediate transfer member, according to a type of image forming operation.

An image forming apparatus according to still another aspect of the present invention includes an image forming station that includes an image carrier configured to hold a toner image and a pattern image; an intermediate transfer member on which the toner image is transferred, a secondary transfer unit configured to contact with and separate from the intermediate transfer member; a detecting unit configured to optically detect an amount of toner adhering to the pattern image to obtain a value, the detecting unit arranged downstream of rotation of the intermediate transfer member to the secondary transfer unit, the pattern image formed in a region in which a regular image is not formed; and a control unit that controls any one of an image forming condition and an amount of toner to be replenished depending on the value. The control unit further controls separating timing at which the secondary transfer unit separates from the intermediate transfer member and contacting timing at which the secondary transfer unit contacts with the intermediate transfer member, according to a type of image forming operation.

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Exemplary embodiments of the present invention will be described below with reference to accompanying drawings. The present invention is not limited to these embodiments.

Figure 1:
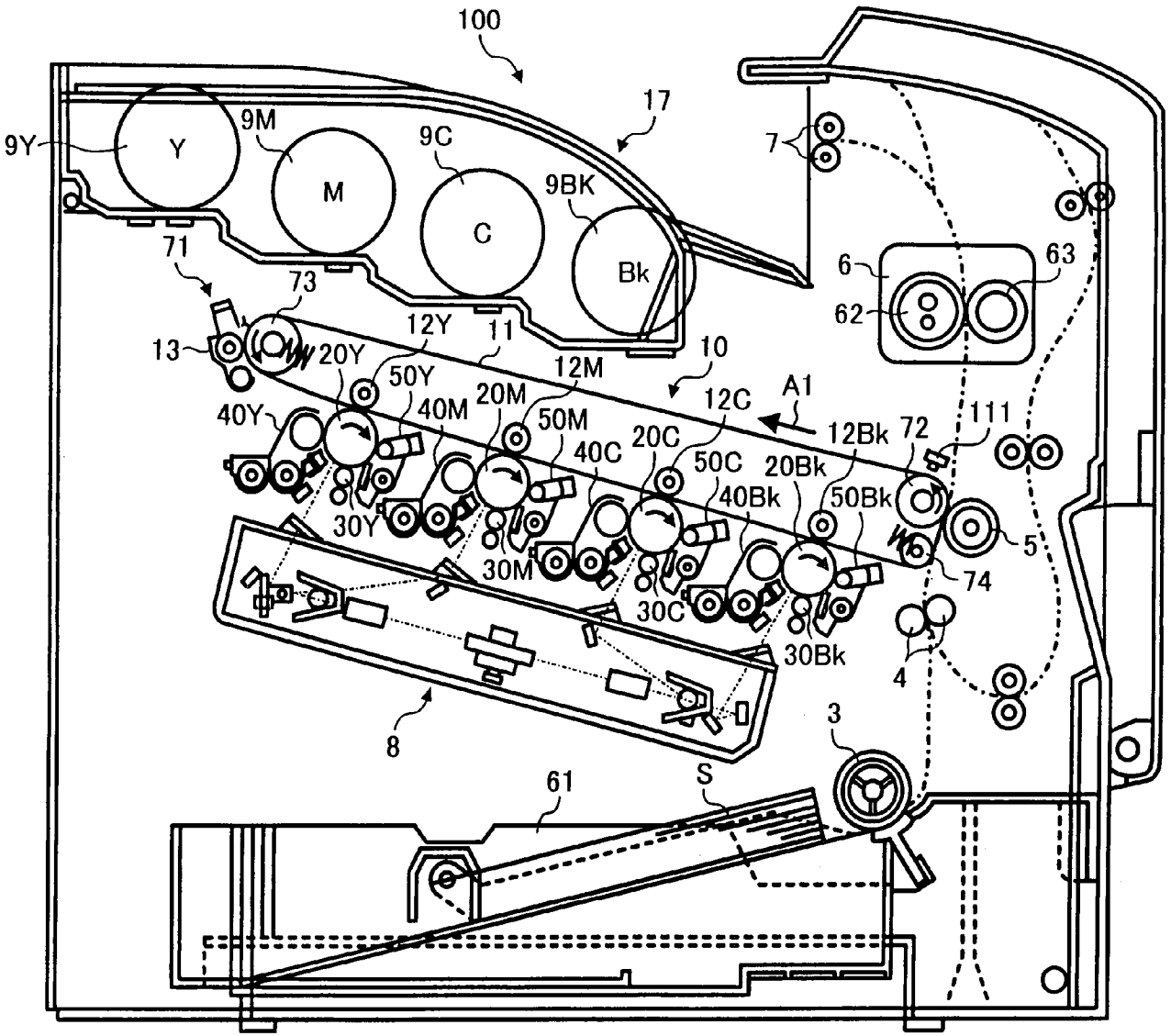
FIG. 1 is a schematic of an image forming apparatus to which an image-density detecting method according to an embodiment of the present invention is applied.

FIG. 1 is a schematic of an image forming apparatus 100 according to an embodiment of the present invention. The image forming apparatus 100 is a color printer; however, the present invention can also be applied to a copier, a facsimile machine, a print machine, or a composite machine having multiple functions.

The image forming apparatus 100 employs a tandem structure, in which photosensitive elements 20Y, 20M, 20C, and 20Bk are juxtaposed. On each of the photosensitive elements 20Y, 20M, 20C, and 20Bk, yellow, magenta, cyan, and black images are formed, respectively. An intermediate transfer belt 11 is an endless belt that faces the photosensitive elements 20Y, 20M, 20C, and 20Bk and rotates in a direction A1 indicated by an arrow shown in FIG. 1. By a primary transfer process, visible toner images formed on each of the photosensitive elements 20Y, 20M, 20C, and 20Bk are superposed on the intermediate transfer belt 11. The position at which the primary transfer process is performed is referred to as a primary transfer position. By a secondary transfer process, the images superposed are transferred onto a sheet of transfer paper S by a secondary transfer roller 5. The position at which the secondary transfer process is performed is referred to as a secondary transfer position.

Figure 2:
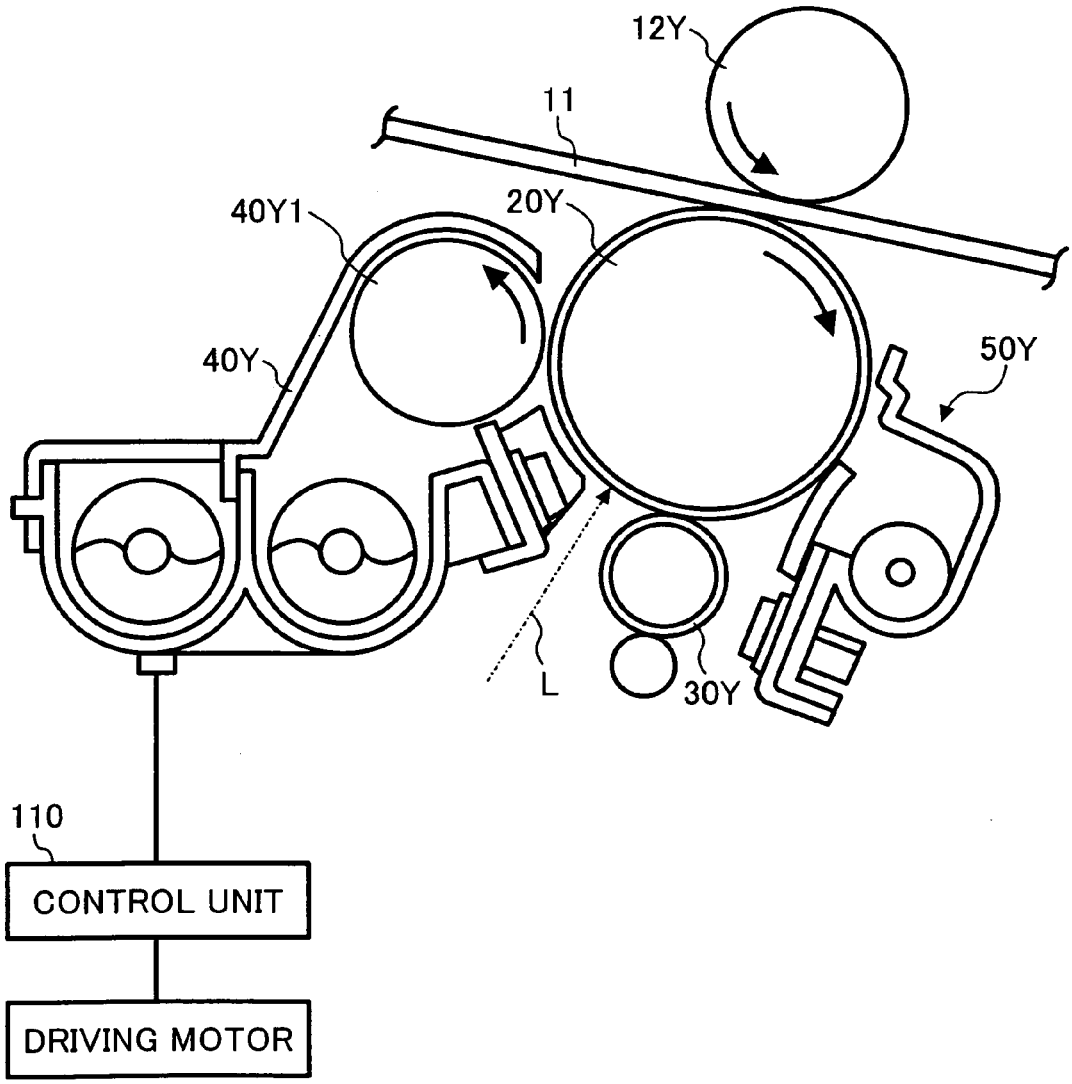
FIG. 2 is a schematic of a process cartridge employed in the image forming apparatus shown in FIG. 1.

Devices for performing an image forming processing are arranged around each of the photosensitive elements 20Y, 20M, 20C, and 20Bk. The photosensitive element 20Y for forming yellow images shown in FIG. 2 is taken as an example. A charging device 30Y that charges the photosensitive element 20Y, a developing device 40Y including a developing sleeve 40Y1, a primary transfer roller 12Y, and a cleaning device 50Y are arranged around the photosensitive element 20Y.

After a charging process, an optical scanning device 8 (shown in FIG. 1) performs a writing process by irradiating a laser beam L to the photosensitive element 20Y. After the cleaning device 50Y removes residual toner from the photosensitive element 20Y, a discharging device (not shown) discharges the photosensitive element 20Y.

The photosensitive element 20Y, the charging device 30Y, the developing device 40Y, and the cleaning device 50Y are provided in a process cartridge that is detachably attached to the image forming apparatus 100. When these devices are depleted, they can be replaced at once with a new process cartridge. A set of the photosensitive element and the process cartridge is referred to as an image forming station.

The primary transfer process is described with reference to FIG. 1. Primary transfer rollers 12Y, 12M, 12C, and 12Bk are located opposite to the photosensitive elements 20Y, 20M, 20C, and 20Bk respectively so that the intermediate transfer belt 11 is sandwiched therebetween. As the intermediate transfer belt 11 rotates in the direction A1, the primary transfer rollers 12Y, 12M, 12C, and 12Bk apply a voltage to the intermediate transfer belt 11 at different timing, such that each image formed on the photosensitive elements 20Y, 20M, 20C, and 20Bk are subsequently superposed on the intermediate transfer belt 11.

The photosensitive elements 20Y, 20M, 20C, and 20Bk are arranged in this order from the upstream side toward the downstream side of the direction A1.

The image forming apparatus 100 includes four image forming stations for forming yellow, magenta, cyan, and black images; a transfer belt unit 10 located above the photosensitive elements 20Y, 20M, 20C, and 20Bk including the intermediate transfer belt 11 and the primary transfer rollers 12Y, 12M, 12C, and 12Bk; the secondary transfer roller 5 that is rotated in conjunction with the rotation of the intermediate transfer belt 11; an intermediate-transfer-belt cleaning device 13 facing the intermediate transfer belt 11 for cleaning the intermediate transfer belt 11; and the optical scanning device 8 located beneath the image forming stations.

The optical scanning device 8 includes a semiconductor laser as a light source, a coupling lens, a fè lens, a toroidal lens, a mirror, and a rotational polygon mirror. The optical scanning device 8 irradiates a laser beam L corresponding to each color of the photosensitive elements 20Y, 20M, 20C, and 20Bk, to form electrostatic latent images on each of the photosensitive elements 20Y, 20M, 20C, and 20Bk.

Furthermore, in the image forming apparatus 100, sheets of the transfer paper S are stacked in a sheet feeding cassette included in a sheet feeding device 61. The transfer paper S is conveyed from the sheet feeding device 61 towards a pair of registration rollers 4. When a sensor (not shown) detects that a leading edge of the transfer paper S has reached the registration rollers 4, the registration rollers 4 convey the transfer paper S to the secondary transfer position between the secondary transfer roller 5 and a secondary-transfer-backup roller 72, in synchronization with a toner image carried on the intermediate transfer belt 11.

After the toner images are transferred onto the transfer paper S, the transfer paper S is conveyed to a fixing device 6 that fixes the toner images onto the transfer paper S by a heat-roller fixing method. The transfer paper is then discharged out of the image forming apparatus 100 onto a discharge tray 17 by a discharge roller 7. Beneath the discharge tray 17, there are provided toner bottles 9Y, 9M, 9C and 9Bk containing yellow, magenta, cyan, and black toner, respectively.

In addition to the intermediate transfer belt 11 and the primary transfer rollers 12Y, 12M, 12C, and 12Bk, the transfer belt unit 10 also includes the secondary-transfer-backup roller 72, a cleaning backup roller 73, and a tension roller 74, around which the intermediate transfer belt 11 is wound around. The secondary-transfer-backup roller 72 and the secondary transfer roller 5 form a secondary transfer nip at which the intermediate transfer belt 11 is sandwiched.

The cleaning backup roller 73 and the tension roller 74 each include a spring to apply tension to the intermediate transfer belt 11. The transfer belt unit 10, the secondary transfer roller 5, and the intermediate-transfer-belt cleaning device 13 constitute a transfer device 71.

The sheet feeding device 61 has a feeding roller 3 that contacts a top surface of a top sheet located on a top of a pile of the transfer paper S stacked in the sheet feeding cassette.

The feeding roller 3 rotates in a counterclockwise direction to convey the top sheet of transfer paper S towards the registration rollers 4.

The fixing device 6 includes a fixing roller 62 in which a heat source is provided, and a pressurizing roller 63 that is pressed against the fixing roller 62. When the transfer paper S carrying a toner image passes through a fixing part between the fixing roller 62 and the pressurizing roller 63, the toner image is fixed onto the transfer paper S by heat and pressure.

The intermediate-transfer-belt cleaning device 13 includes a cleaning brush (not shown) and a cleaning blade (not shown) that are arranged in contact with the intermediate transfer belt 11, for brushing off and removing residual toner on the intermediate transfer belt 11. Moreover, the intermediate-transfer-belt cleaning device 13 includes a discharge mechanism for conveying and discharging the toner removed.

Figure 3:
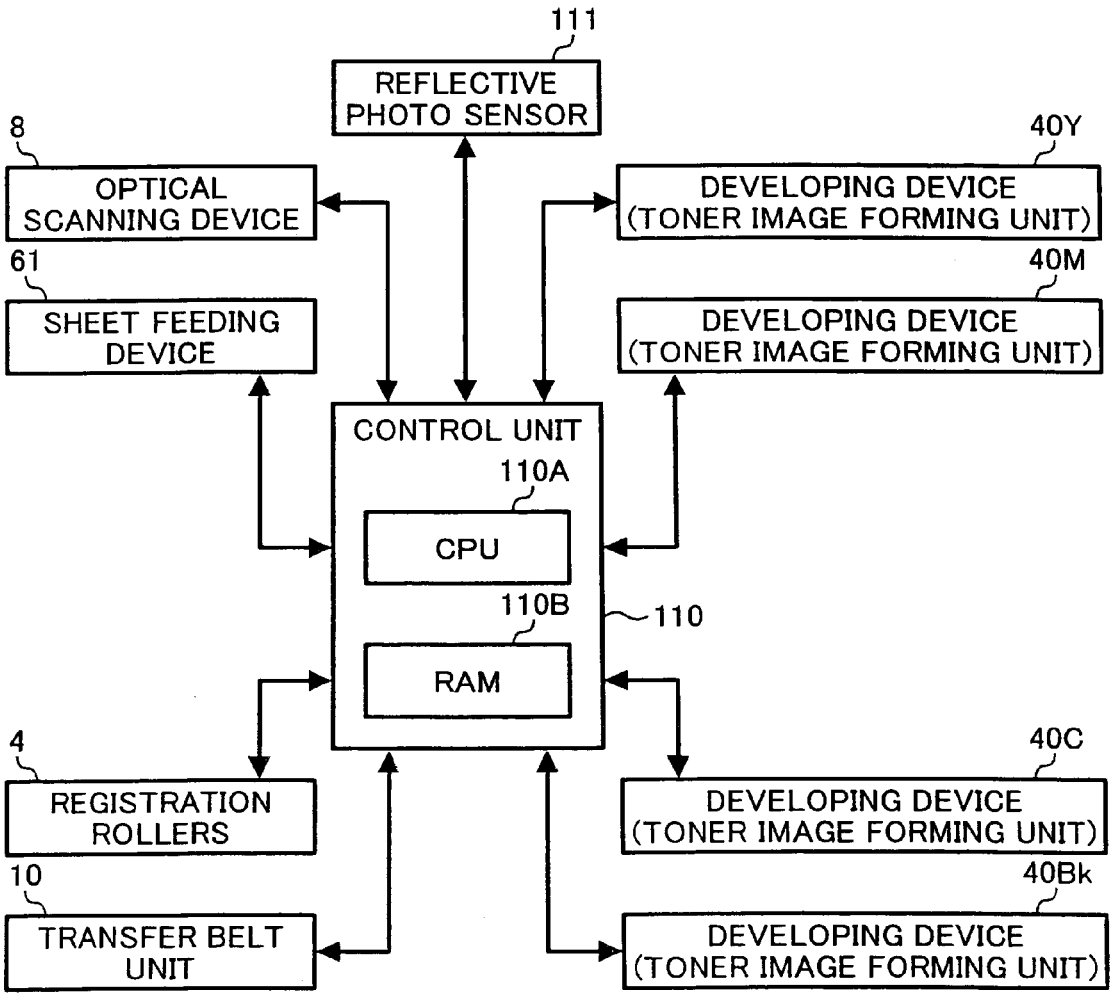
FIG. 3 is a block diagram of a control unit that performs the image-density detecting method.

FIG. 3 is a block diagram of a control unit 110 employed in the image forming apparatus 100. The control unit 110 is a microcomputer that includes a central processing unit (CPU) 110A for executing an image forming sequence program and performing an arithmetic processing, and a random access memory (RAM) 110B that is a non-volatile memory for storing data. The control unit 110 is connected to an input/output unit (not shown) through an interface. The input/output unit is connected to the developing devices 40Y, 40M, 40C, and 40Bk, the optical scanning device 8, the sheet feeding device 61, the registration rollers 4, the transfer belt unit 10, and a reflective photo sensor 111.

The reflective photo sensor 111 is positioned opposite to the secondary-transfer-backup roller 72, and outputs signals in response to an optical reflectance from the intermediate transfer belt 11. Either a diffuse light sensor or a specular light sensor is employed as the reflective photo sensor 111. The reflective photo sensor 111 obtains the difference between a reflective light amount from the surface of the intermediate transfer belt 11 and a reflective light amount from a pattern image as a sufficient output value. The present embodiment employs the diffuse light sensor, because it can detect a high-density portion of color toner.

The control unit 110 performs an image adjustment operation to improve an image forming performance at specific timing (when a predetermined time duration passes after switching on a main power supply, when a predetermined number of sheets are printed out, etc.). For example, at the specific timing, pattern images are formed on the intermediate transfer belt 11 after a regular image. The reflective photo sensor 111 detects the pattern images to obtain image information such as image density. Based on the image information, the control unit 110 examines image forming performance of each developing device. Based on a result of examination, the control unit 110 performs a process control to change image forming conditions so that the image forming performance is improved. As another example of an image adjustment operation, the control unit 110 performs a toner replenishing control to change the amount of toner so that an optimum toner density is achieved.

At a specific timing, the photosensitive elements 20Y, 20M, 20C, and 20Bk are rotated and uniformly charged. In a regular printing process, a fixed voltage, for example, 700 volts (V), is applied. However, when forming a pattern image, the voltage is gradually increased. Subsequently, the optical scanning device 8 irradiates a laser beam L to form an electrostatic latent image of a pattern image on each photosensitive element 20Y, 20M, 20C, and 20Bk. The developing devices 40Y, 40M, 40C, and 40Bk develop the electrostatic latent images to form visual images.

Accordingly, a pattern images of each color is formed on each of the photosensitive element 20Y, 20M, 20C, and 20Bk. At the developing procedure, the control unit 110 gradually increases a developing bias value applied to the developing sleeve (denoted by 40Y1 in FIG. 2) of each developing device.

The pattern images of each color are transferred onto the intermediate transfer belt 11, so as not to overlap each other, thereby forming a pattern block.

Figure 4:
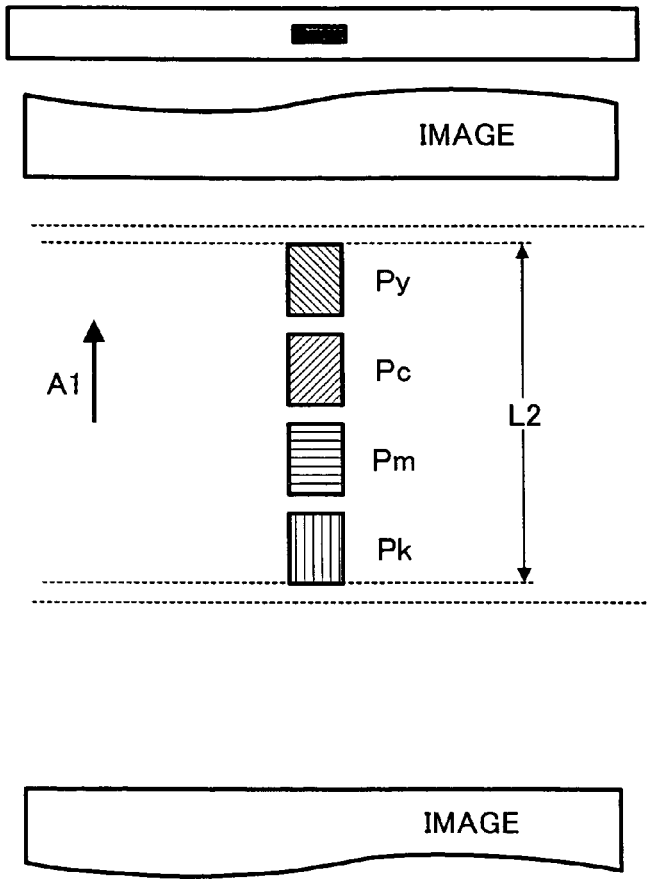
FIG. 4 is a schematic of pattern images used in the image-density detecting method.

FIG. 4 is a schematic of the pattern block. A reference character "k" is used for representing black, instead of "Bk" used in FIG. 1.

In the image forming apparatus 100, each of the pattern images are 15 millimeters (mm) long and 15 mm wide, and are arranged keeping an interval of 5 mm. Thus, a total length L2 occupied by pattern images Py, Pc, Pm, and Pk on the intermediate transfer belt 11 is 75 mm.

Figure 5:
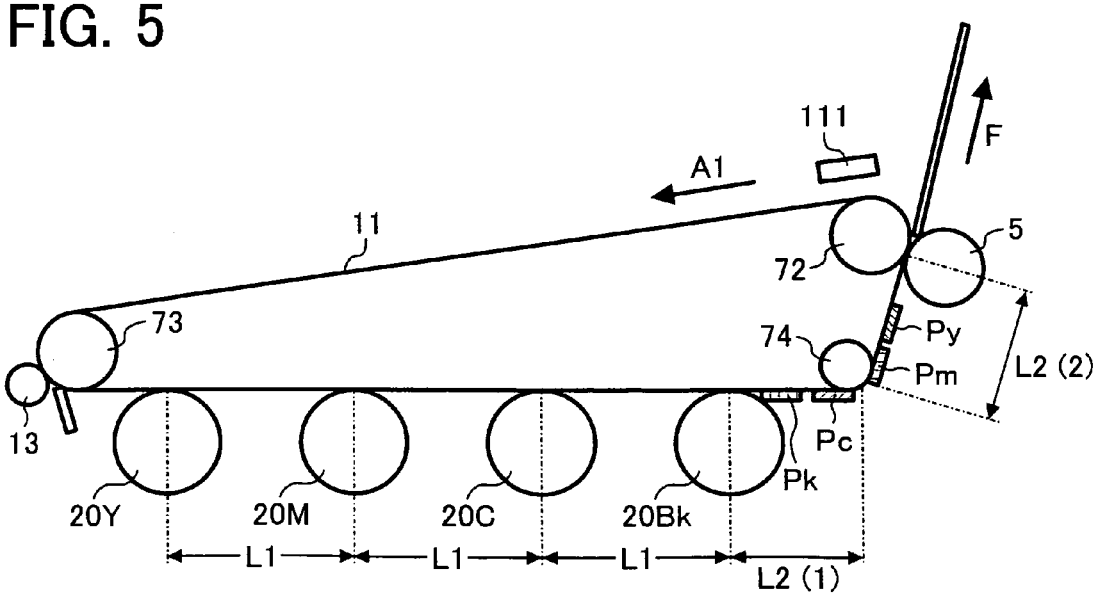
FIG. 5 is a schematic for illustrating an arrangement of photosensitive elements for forming the pattern images.

FIG. 5 is a schematic for illustrating an arrangement of the photosensitive elements 20Y, 20M, 20C, and 20Bk. The photosensitive elements 20Y, 20M, 20C, and 20Bk are arranged so that the pattern images do not overlap each other.

The interval L1 between each photosensitive element 20Y, 20M, 20C, and 20Bk is 100 mm. This is longer than the total length (L2=75 mm) occupied by pattern images Py, Pc, Pm, and Pk. Thus, each pattern image Py, Pc, Pm, and Pk can be transferred onto the intermediate transfer belt 11 without overlapping each other. Moreover, a distance L2 (1) from the center of the photosensitive element 20Bk that forms the last pattern image in the pattern block, to a position on the tension roller 74 in contact with the intermediate transfer belt 11 is 75 mm. A distance L2 (2) from the position on the tension roller 74 in contact with the intermediate transfer belt 11 to the secondary transfer nip between the secondary-transfer-backup roller 72 and the secondary transfer roller 5 is 75 mm. Accordingly, the total length (L2=75 mm) of the pattern images Py, Pc, Pm, and Pk is shorter than a distance between the primary transfer position of the last color (in this case, black) and the secondary transfer position. Thus, the pattern images Py, Pc, Pm, and Pk can be transferred without overlapping each other.

When each pattern image on the intermediate transfer belt 11 passes a position facing the reflective photo sensor 111, the reflective photo sensor 111 detects a reflective light amount, and outputs the amount as an electric signal to the control unit 110.

The control unit 110 calculates an optical reflectance of each pattern image based on data sequentially output from the reflective photo sensor 111. The optical reflectance is stored as density pattern data in the RAM 110B. After passing by the reflective photo sensor 111, the pattern block is cleaned off by the intermediate-transfer-belt cleaning device 13.

When the pattern images are detected by the reflective photo sensor 111, the control unit 110 controls the secondary transfer roller 5 to contact with/separate from the intermediate transfer belt 11. Specifically, the secondary transfer roller 5 is separated from the intermediate transfer belt 11 when the pattern images are detected by the reflective photo sensor 111. The secondary transfer roller 5 comes into contact with the intermediate transfer belt 11 after the pattern images pass by the reflective photo sensor 111 not the secondary transfer roller 5.

An impact of the secondary transfer roller 5 causes the intermediate transfer belt 11 to shake and sway when the secondary transfer roller 5 contacts with/separates from the intermediate transfer belt 11. If the secondary transfer roller 5 contacts the intermediate transfer belt 11 soon after the pattern images pass by the secondary transfer roller 5, the intermediate transfer belt 11 might still be shaking or swaying when the pattern images reach the position facing the reflective photo sensor 111.

Experiments were conducted to examine detection errors of the reflective photo sensor 111. Results of the experiment are shown in table 1.

TABLE 1

| Contacting timing of secondary transfer roller | Detection error rate of reflective photo sensor |
|---|---|
| Soon after pattern block passes by secondary transfer position | 20% |
| Soon after pattern block passes by reflective photo sensor | 5% |

The detection error rate is lower when the secondary transfer roller 5 contacts the intermediate transfer belt 11 after the pattern images pass by the reflective photo sensor 111 (5%), as compared to when the pattern images pass by the secondary transfer roller 5 (20%). Thus, when the secondary transfer roller 5 contacts the intermediate transfer belt 11 after the pattern images pass by the reflective photo sensor 111, density of a pattern image can be detected more accurately.

Moreover, time for detecting the pattern images can be reduced, by shortening a period of the intermediate transfer belt 11 moving from the secondary transfer roller 5 to the reflective photo sensor 111. Accordingly, in the present embodiment, the reflective photo sensor 111 is located as closely as possible to the secondary transfer roller 5. The reflective photo sensor 111 can be located in front of the secondary transfer roller 5 to reduce the distance between the reflective photo sensor 111 and the secondary transfer roller 5. In this case, however, it is difficult to form the pattern images corresponding to each color within a relatively short distance, and the secondary transfer roller 5 is likely to cause an impact on the intermediate transfer belt 11, thus increasing the detection error rate of the reflective photo sensor 111. Accordingly, it is preferable to make the secondary transfer roller 5 contact the intermediate transfer belt 11 after the pattern images pass by the reflective photo sensor 111.

Figure 6:
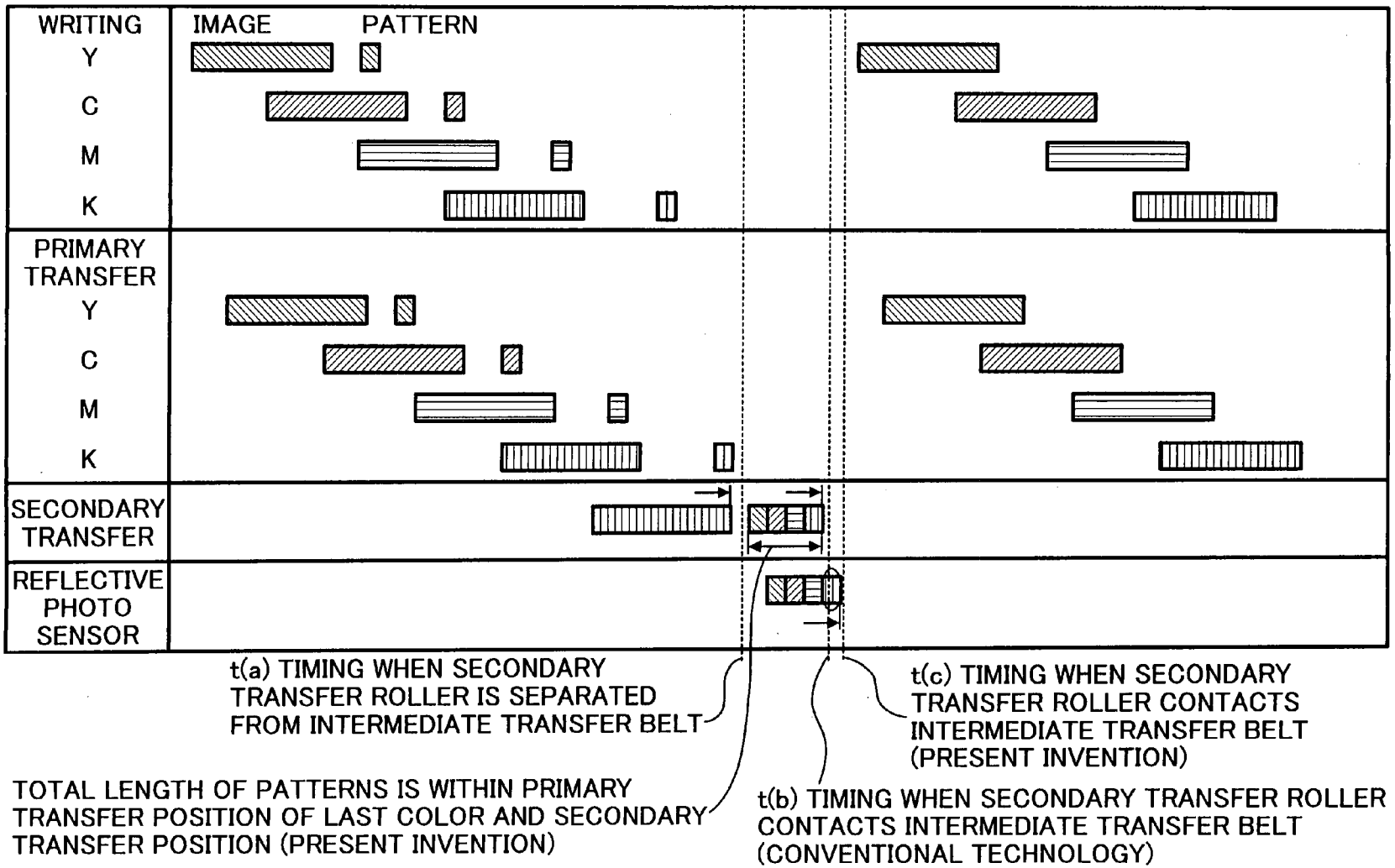
FIG. 6 is a timing chart of an image forming processing for forming the pattern images.

FIG. 6 is a timing chart of an image forming processing for forming the pattern images shown in FIG. 4. The vertical axis represents different stages in the image forming processing, and the horizontal axis represents time.

At timing t(a), right before a pattern block enters the secondary transfer position, the secondary transfer roller 5 separates from the intermediate transfer belt 11. The four pattern images of different colors in the pattern block sequentially pass by the reflective photo sensor 111.

The secondary transfer roller 5 contacts the intermediate transfer belt 11 at timing t(b) in the conventional technology, and at timing t(c) in the present embodiment. At the timing t(b), the reflective photo sensor 111 is still in the process of detecting the pattern block. Therefore, the impact of the secondary transfer roller 5 causes the intermediate transfer belt 11 to shake and sway, resulting in significant detection errors. However, at the timing t(c), the reflective photo sensor 111 has finished detecting the pattern block. Thus, the detection procedure is unaffected by the impact of the secondary transfer roller 5. As a result, detection errors are prevented so that the pattern block can be detected with high accuracy.

The intermediate transfer belt 11 is most likely to shake and sway at a portion stretched out in the circumferential direction. Thus, the reflective photo sensor 111 is preferably located so as to face the intermediate transfer belt 11 at a position other than such a portion. Experiments were conducted to examine an ideal position of the reflective photo sensor 111. Results of the experiment are shown in table 2.

TABLE 2

| Mounting position of reflective photo sensor | Detection error of reflective photo sensor | Mounting error of reflective photo sensor |
|---|---|---|
| B − r | 2% | 7% |
| B | 5% | 2% |
| B + r | 7% | 3% |
| B + 2r | 8% | 5% |

Figure 7:
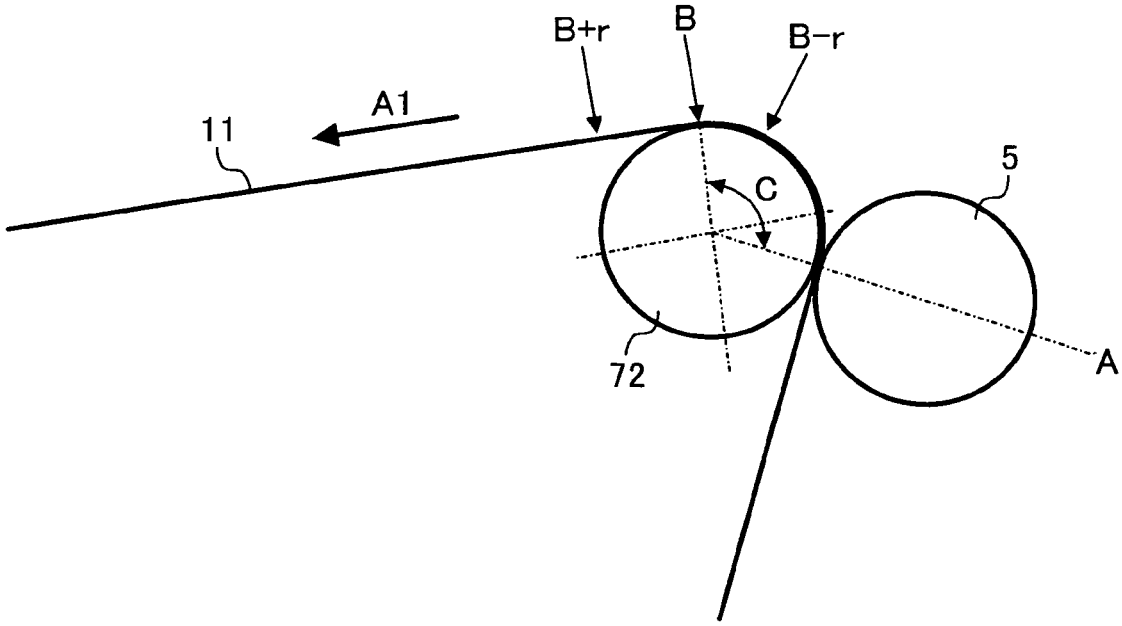
FIG. 7 is a schematic for illustrating a configuration for preventing an intermediate transfer belt from shaking and swaying.

FIG. 7 is a schematic for illustrating a configuration for preventing the intermediate transfer belt 11 from shaking and swaying. The intermediate transfer belt 11 is wound on the secondary-transfer-backup roller 72 from a position (A) to a position (B). Right before a pattern image reaches the position (A), the secondary transfer roller 5 separates from the intermediate transfer belt 11. When the pattern image reaches the position (B), the secondary transfer roller 5 contacts the intermediate transfer belt 11. It is preferable that a winding angle that is an angle formed between the positions (A) and (B) with respect to an axis of the secondary-transfer-backup roller 72 is 90 degrees or more. In this example, the winding angle is 100 degrees.

Assuming that (r) represents the radius of the secondary transfer roller 5, the center of the reflective photo sensor 111 faces the intermediate transfer belt 11 within a range between a position (B+r) and a position (B−r).

As is evident from the results shown in Table 2, the further the reflective photo sensor 111 is located from the position (B), the higher the detection error rate becomes. Moreover, the probability that the intermediate transfer belt 11 shakes is affected by the winding angle. This probability is inversely proportional to the radius of the secondary-transfer-backup roller 72. Accordingly, when the radius of the secondary-transfer-backup roller 72 is smaller, the shaken portion of the intermediate transfer belt 11 is closer to the position (B). Furthermore, if the reflective photo sensor 111 is located in front of the position (B), a mounting error rate of the reflective photo sensor 111 increases because of the curvature of the secondary-transfer-backup roller 72, which leads to a higher detection error rate.

Thus, in the present embodiment, the detection error rate is maintained at 10% or less by locating the reflective photo sensor 111 between the position (B−r) and the position (B+r). As a result, detection errors are prevented so that the pattern block can be detected with high accuracy.

Figure 8:
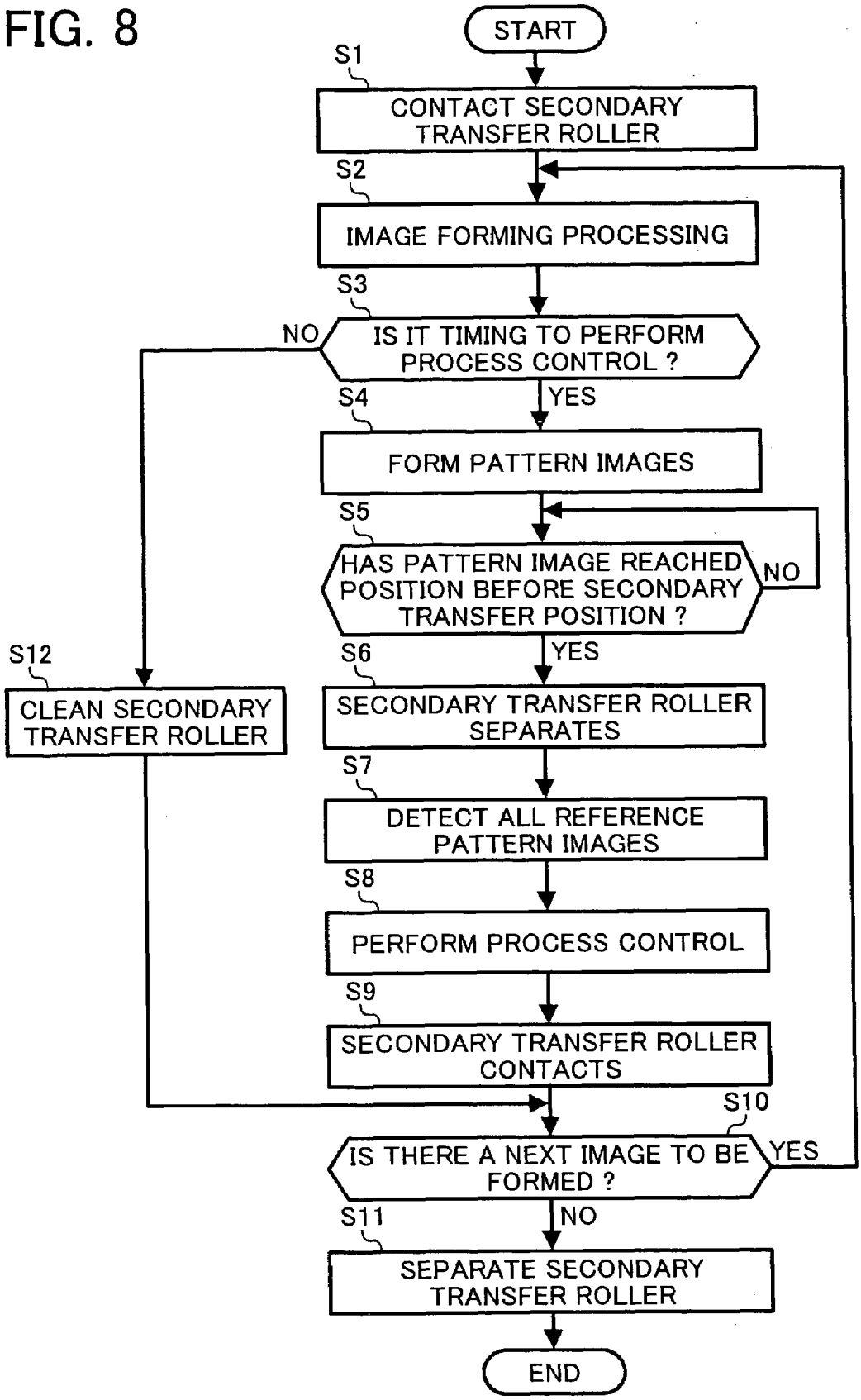
FIG. 8 is a flowchart of a processing performed by the control unit.

FIG. 8 is a flowchart of a processing performed by the control unit 110. When an image forming operation is commanded, the secondary transfer roller 5 contacts the intermediate transfer belt 11 to perform the secondary transfer process (step S1), and the image forming processing is performed (step S2).

The control unit 110 determines whether it is a timing to perform process control, based on image data such as the number of times of image forming performed (step S3).

When it is timing to perform process control, pattern images are formed (step S4). The process control in this example is a control for improving image forming performance, for example, in terms of image density.

The control unit 110 determines whether the leading pattern image has reached a predetermined position before the secondary transfer position (step S5). If it has, the secondary transfer roller 5 is separated from the intermediate transfer belt 11 (step S6), and the reflective photo sensor 111 detects the pattern images (step S7).

Based on a result of detection obtained at step S7, the process control is performed (step S8). When the process control is completed, the secondary transfer roller 5 contacts the intermediate transfer belt 11 (step S9). A contacting timing of the secondary transfer roller 5 at which the secondary transfer roller 5 contacts the intermediate transfer belt 11 is controlled to be soon after all pattern images pass by the reflective photo sensor 111, as described with reference to FIG. 6.

On the other hand, when it is not a timing to perform process control at step S3, the secondary transfer roller 5 is cleaned (step S12). Specifically, an electric field opposite to that used in a regular transfer process is applied, so as to transfer the toner adhering to the secondary transfer roller 5 to the intermediate transfer belt 11. The intermediate-transfer-belt cleaning device 13 then removes the toner from the intermediate transfer belt 11.

When the secondary transfer roller 5 contacts the intermediate transfer belt 11, the control unit 110 determines whether there is a next image to be formed (step S10). If not, the secondary transfer roller 5 separates from intermediate transfer belt 11 to be in standby (step S11).

Figure 9:
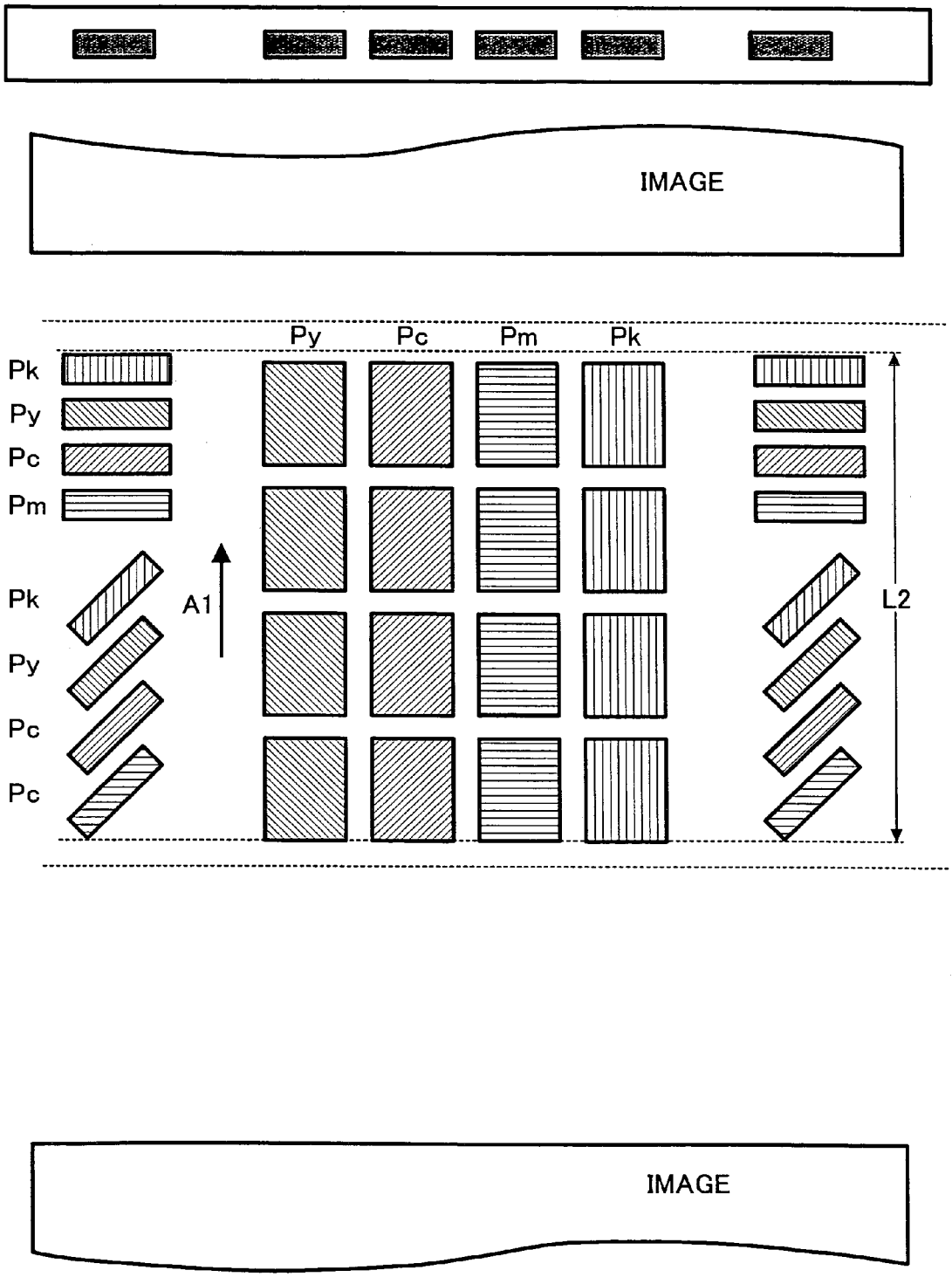
FIG. 9 is a variation of the pattern images shown in FIG. 4.

FIG. 9 is a variation of the pattern block shown in FIG. 4. In this example, pattern images of different colors are arranged perpendicular to the circumferential direction of the intermediate transfer belt 11, and the reflective photo sensor is arranged at a location corresponding to each color.

The pattern images are located within the same area as that of FIG. 4. Moreover, pattern images for indicating image location information are formed. Accordingly, a plurality of image information is included within a limited area (L2) to be detected by the reflective photo sensor 111 at once. As a result, time for the detecting process can be saved.

Figure 10:
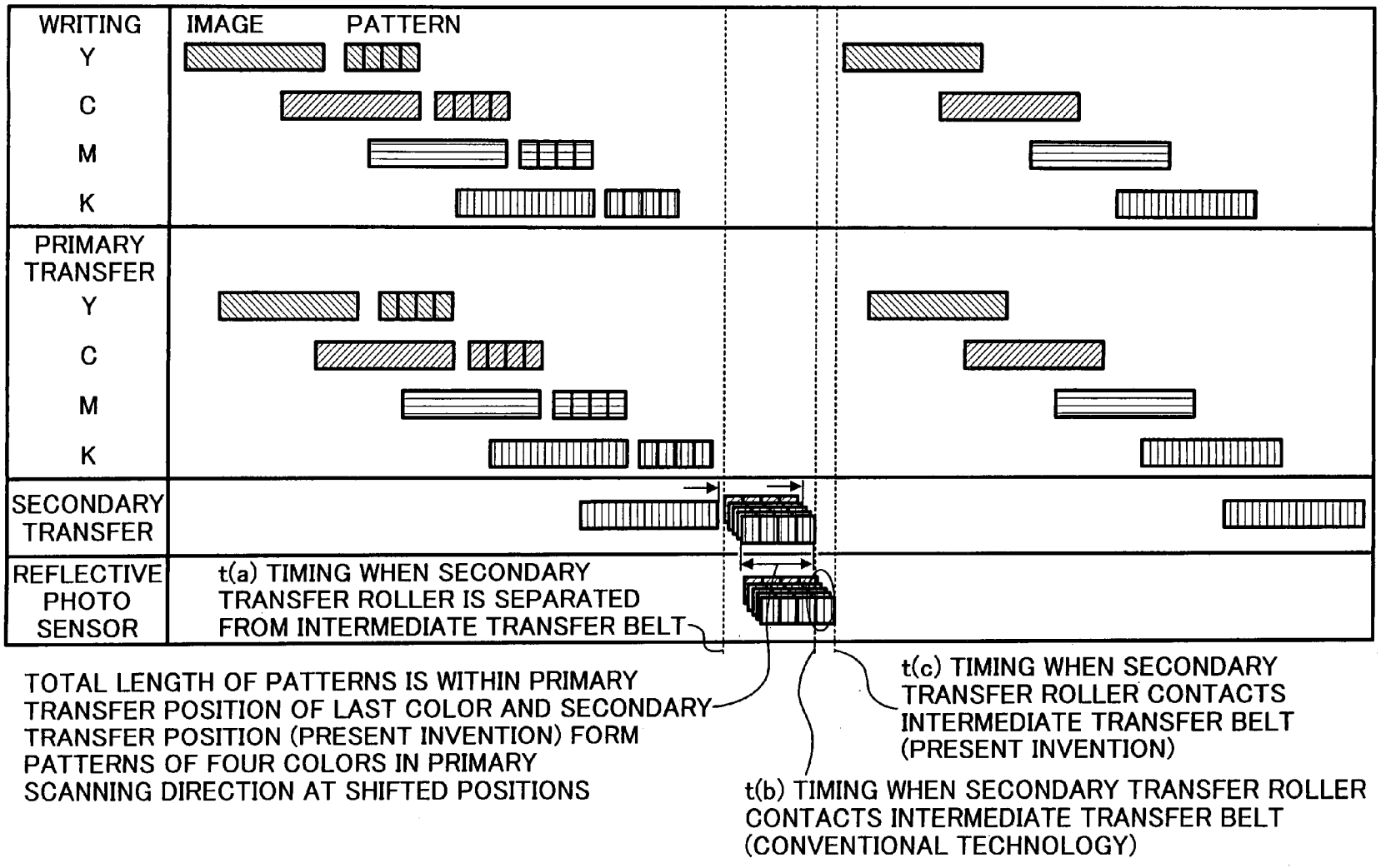
FIG. 10 is a timing chart of an image forming processing for forming the pattern images shown in FIG. 9.

FIG. 10 is a timing chart of an image forming processing for forming the pattern images shown in FIG. 9. Similarly to the timing chart shown in FIG. 6, at timing t(a) right before the pattern block enters the secondary transfer position, the secondary transfer roller 5 separates from the intermediate transfer belt 11. Because the pattern images of four colors are arranged perpendicular to the circumferential direction of the intermediate transfer belt 11, they pass by the reflective photo sensor 111 simultaneously.

The secondary transfer roller 5 contacts the intermediate transfer belt 11 at timing t(c), soon after the pattern block passes the reflective photo sensor 111. Thus, detection errors are prevented so that the pattern block can be detected with high accuracy.

Figure 11:
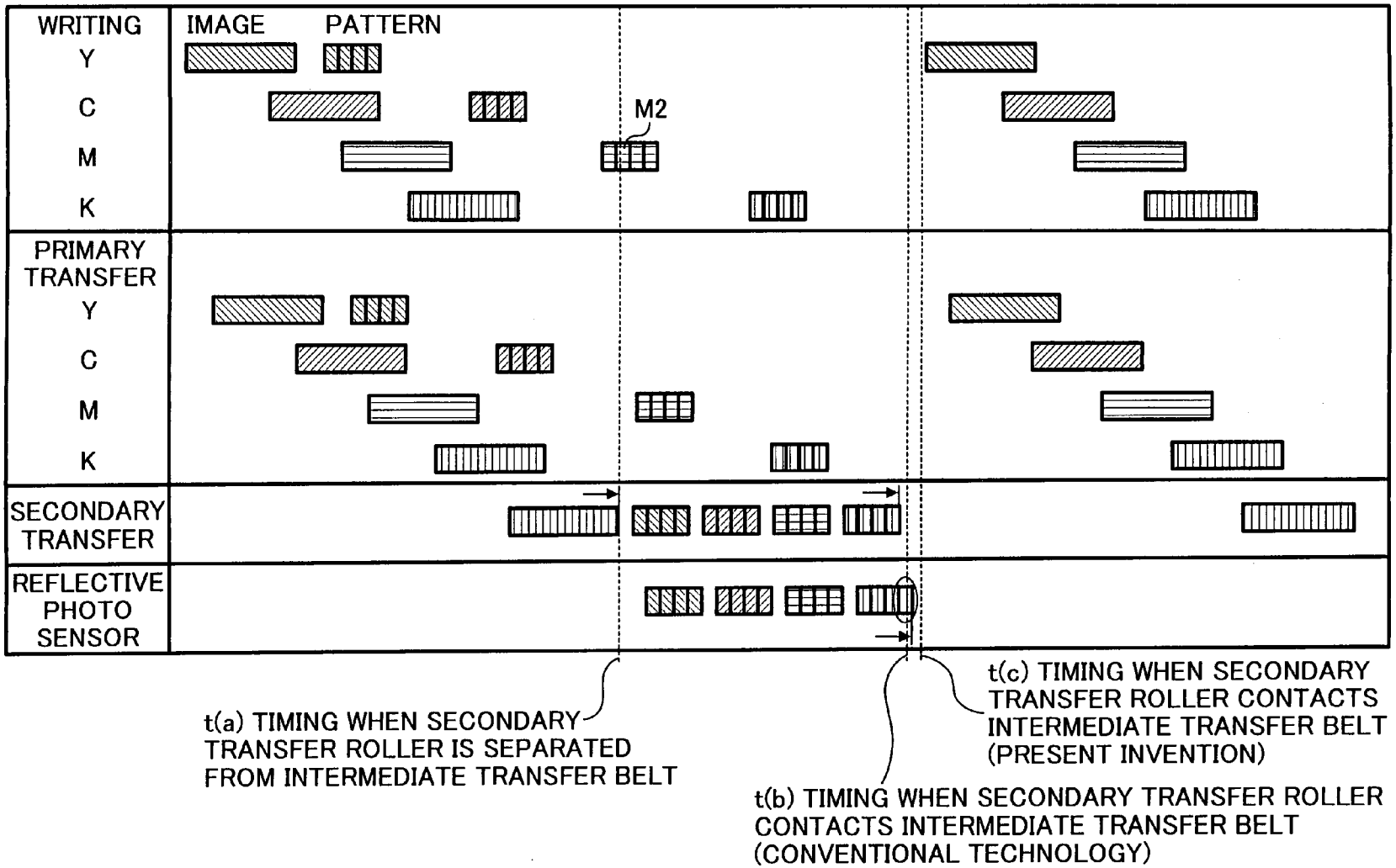
FIG. 11 is a timing chart of a conventional image forming processing for forming the pattern images shown in FIG. 9.
Figure 12:
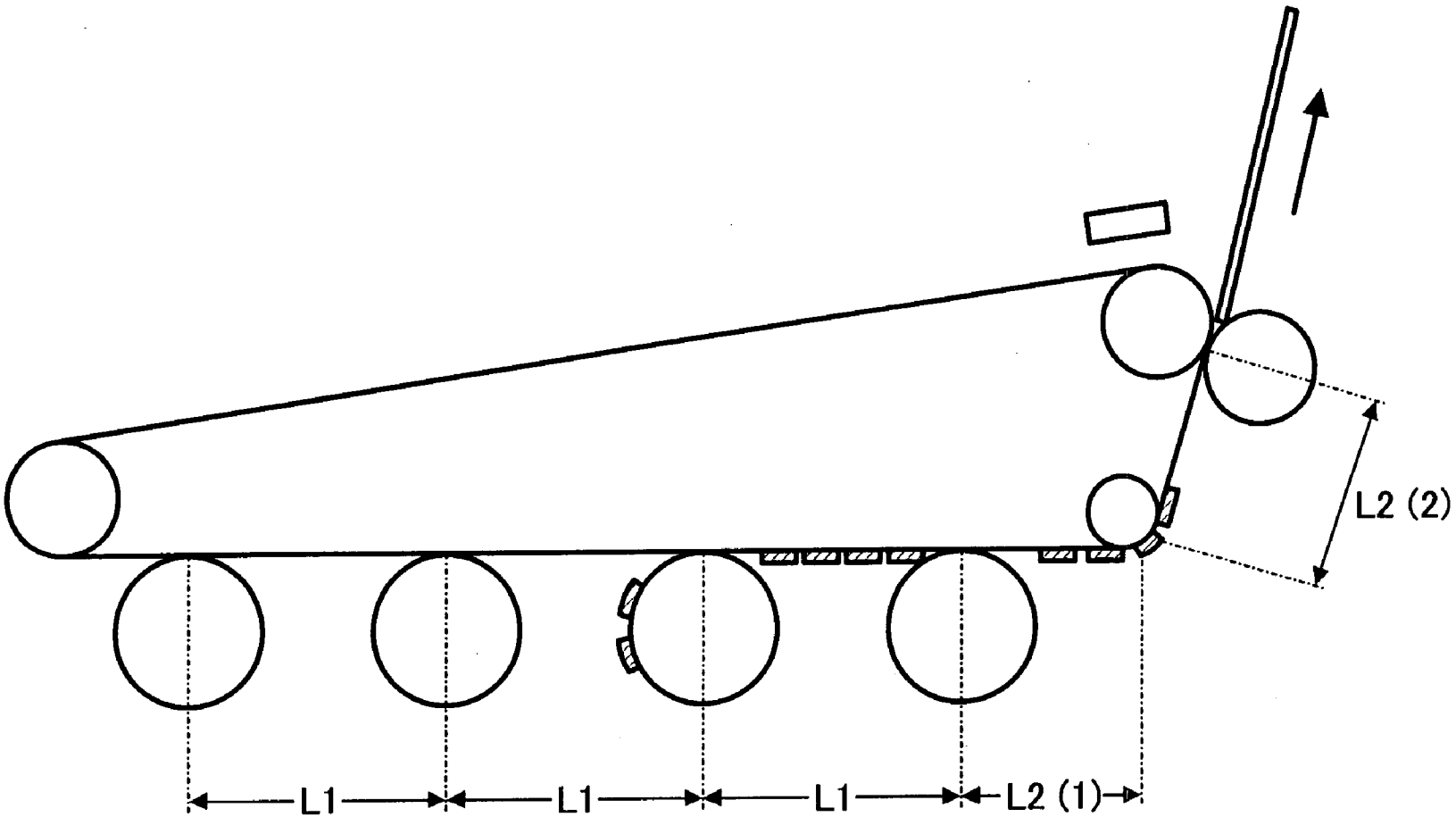
FIG. 12 is a schematic for illustrating positions of the pattern images when the conventional image forming processing shown in FIG. 11 is performed.

As shown in a timing chart shown in FIG. 11, when pattern images of four gradations for the same color are formed, the total length of the pattern block is four times longer than that in the case shown in FIG. 4. Thus, the pattern block is longer than the distance (denoted by L2(l) and L2(2) in FIG. 5) between the primary transfer position of the last color (in this case, black) and the secondary transfer position. When the secondary transfer roller 5 is separated from the intermediate transfer belt 11 when the pattern images of the first color reaches the position right before the secondary transfer position, the other pattern images might be in the process of being formed or transferred, if the pattern images are successively formed. For example, when the secondary transfer roller 5 is separated, the second pattern image of magenta (denoted by M2 in FIG. 11) is in the writing process. The separation of the secondary transfer roller 5 causes the intermediate transfer belt 11 to shake and sway. As a result, the pattern image M2 is not formed properly, and image data for magenta cannot be detected accurately. The positions of the pattern images in this case are shown in FIG. 12.

Figure 13:
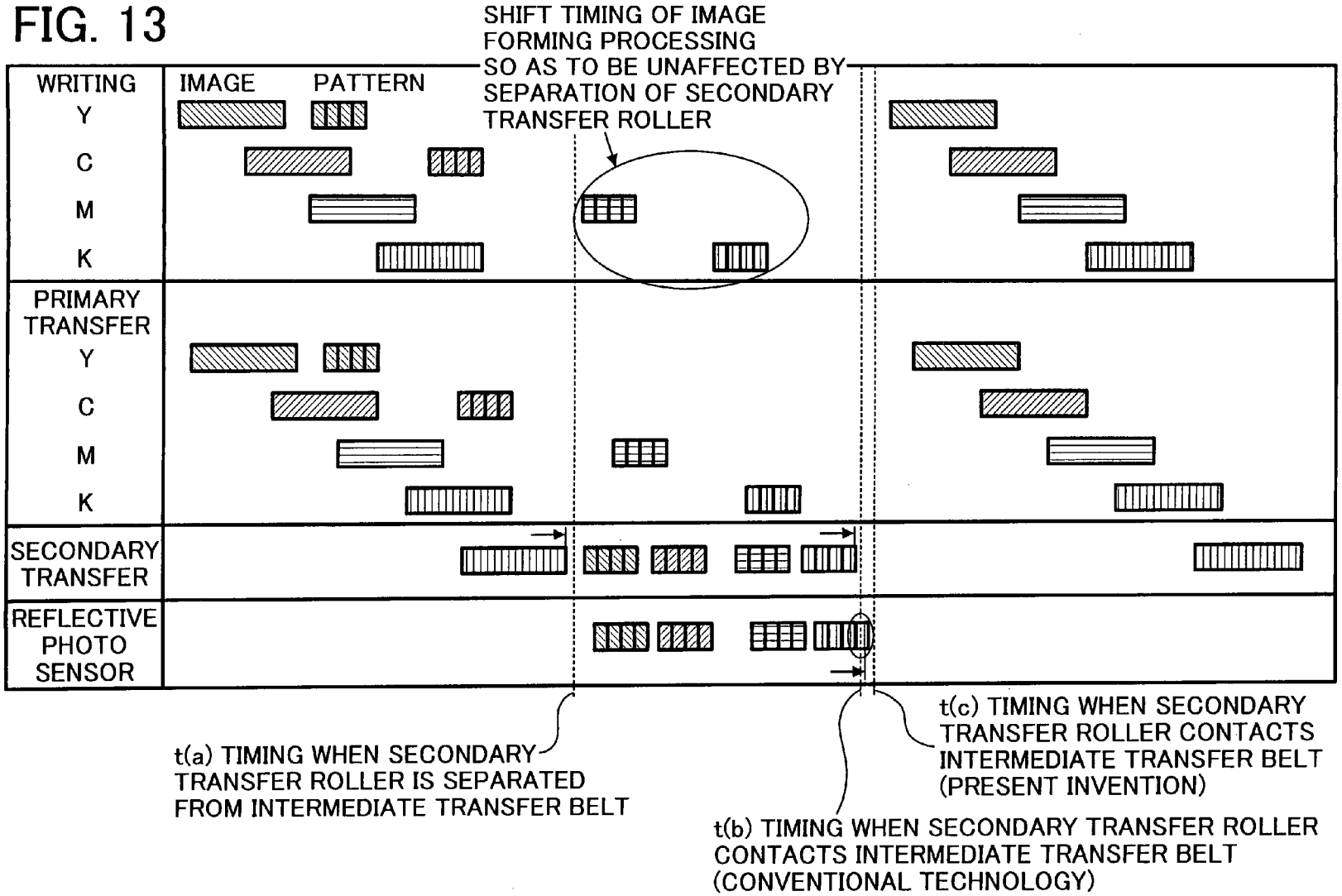
FIG. 13 is a timing chart of an image forming processing for forming pattern images according to the embodiment.

To solve this problem, the image forming processing of a pattern image (step S4 in FIG. 8) is performed so as not to coincide with a separating timing of the secondary transfer roller 5 at which the secondary transfer roller 5 separates from the intermediate transfer belt 11. Specifically, the writing, developing, and transferring processes of all pattern images are not performed while a separating action of the secondary transfer roller 5 separating from the intermediate transfer belt 11. This timing is described in FIG. 13.

The secondary transfer roller 5 contacts the intermediate transfer belt 11 at the timing t(c), soon after all of the pattern images pass the reflective photo sensor 111. Thus, the detection process is unaffected by the shaking/swaying of the intermediate transfer belt 11, preventing accuracy of the detection process from deteriorating.

Figure 14:
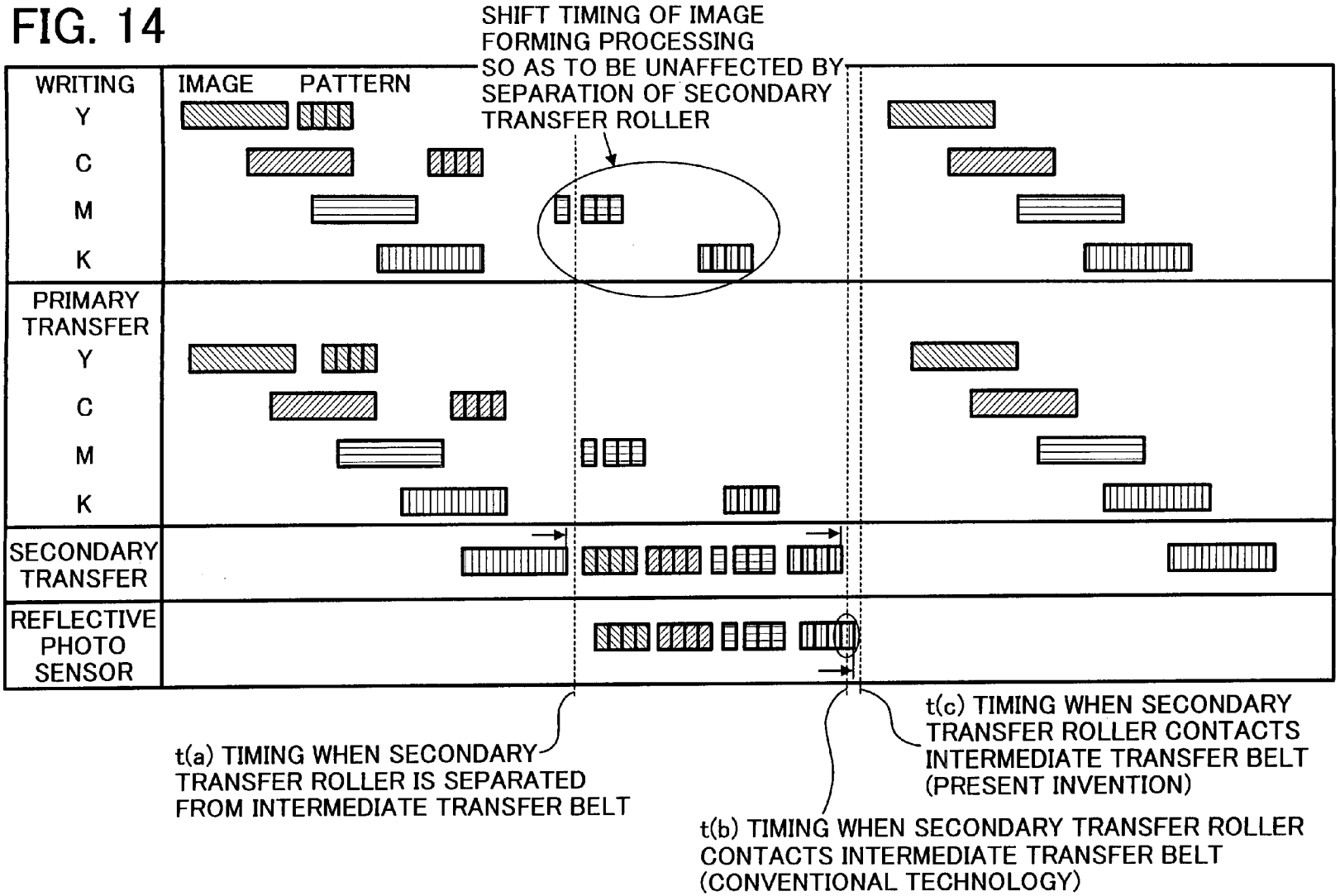
FIG. 14 is another timing chart of the image forming processing shown in FIG. 13.

Another approach to prevent the formation of a pattern image from being affected by the separation of the secondary transfer roller 5 is described below. As shown in FIG. 14, a timing of writing a particular pattern image included in a set of pattern images is delayed, so as not to coincide with the separating timing of the secondary transfer roller 5. The developing procedure is delayed in accordance with the delay in the writing process, so that it is unaffected by the shaking/swaying of the intermediate transfer belt 11.

The following are process conditions of the components used in the embodiment. An organic photo conductor (OPC) is used as the photosensitive element. A charging roller that contacts or comes close to the photosensitive element is used as the charging device, to uniformly charge the photosensitive element at −200 V to −2,000 V. A laser beam is irradiated to the photosensitive element charged to form an electrostatic latent image corresponding to an original image. Toner used for developing is negatively charged to perform a negative-positive developing process for developing the electrostatic latent image into a visual toner image. A thermosetting resin belt having a thickness of 0.10 mm, a width of 246 mm, and an inner circumference of 796 mm is used as the intermediate transfer belt 11 that moves at 150 mm/sec.

Under the above conditions, volume resistivity of the intermediate transfer belt 11 is $10^7$ to $10^{12}$ O cm. The volume resistivity was obtained by applying 100 V to the intermediate transfer belt 11 for 10 seconds, using a measuring method according to Japanese Industrial Standards (JIS) K 6911. Moreover, surface resistivity of the intermediate transfer belt 11 is 109 O/$cm^2$ to 1014 O/$cm^2$. This was measured with a resistivity measuring instrument "Hiresta-IP", manufactured by Mitsubishi Petrochemical Co., Ltd. The surface resistivity can be measured by a surface resistivity measuring method according to JIS K 6911. A roller with a diameter of 26 mm and a width of 230 mm, made of urethane resin foam, is used as the secondary transfer roller 5. Examples of the method of performing the process control described in FIG. 8 are disclosed in Japanese Patent Application Laid Open No. 2002-132097 (density control method by measuring density of a pattern image) and Japanese Patent No. 2642351 (image position control method by detecting a position of a pattern image).

According to the present embodiment, the secondary transfer roller 5 contacts the intermediate transfer belt 11 after the reflective photo sensor 111 completes detecting a pattern image. Accordingly, the detection process is unaffected by an impact of the secondary transfer roller 5 on the intermediate transfer belt 11. Thus, time for detecting the pattern images can be reduced, and detection errors can be prevented.

According to the present embodiment, assuming that the intermediate transfer belt 11 separates from the secondary-transfer-backup roller 72 at the position (B), and the radius of the secondary transfer roller 5 is (r), the reflective photo sensor 111 faces the intermediate transfer belt 11 within a range between a position (B+r) and a position (B−r). Accordingly, the reflective photo sensor 111 detects the pattern images at a position at which the intermediate transfer belt 11 is least likely to shake and sway. Thus, detection errors can be minimized. Furthermore, because of the curvature of the secondary-transfer-backup roller 72, the intermediate transfer belt 11 is caused to shake and sway on the circumference of the secondary-transfer-backup roller 72, in between the positions at which the intermediate transfer belt 11 separates from the secondary-transfer-backup roller 72. Accordingly, the reflective photo sensor 111 is located so as not to face such portion. Thus, detection errors can be minimized.

According to the present embodiment, when more than one pattern image in different gradation is formed, writing, developing, and transferring processes for the pattern image are performed not to coincide with the separating timing and the contacting timing of the secondary transfer roller 5. Thus, the pattern images can be properly formed without being affected by an impact caused by the separating action and contacting action of the secondary transfer roller 5. Thus, the reflective photo sensor 111 can accurately detect image information.

According to the present embodiment, pattern images are formed during a single set of the separating action and the contacting action, and the total length of the pattern images is shorter than the distance between the primary transfer position and the secondary transfer position. Thus, the number of the separating action and the contacting action of the secondary transfer roller 5 is minimized regardless of the number of pattern images, and time being in standby between formations of regular images is reduced.

According to the present embodiment, detection errors of the reflective photo sensor 111 due to shaking and swaying of the intermediate transfer belt 11 are reduced, and time being in standby between forming regular images is reduced.

In the present embodiment, the separating timing of the secondary transfer roller 5 can be changed according to a type of image forming operation and a type of pattern image.

For example, when a single pattern image is formed, the secondary transfer roller 5 separates from the intermediate transfer belt 11 before a writing process for forming the first electrostatic latent image (in this case, at the photosensitive element 20Y) is performed. Accordingly, writing, developing, and transferring can be performed properly without being affected by an impact caused by the separating action of the secondary transfer roller 5.

On the other hand, when more than one pattern images is formed in the circumferential direction of the intermediate transfer belt 11, it takes a long time for all of the pattern images to be formed, compared to the case of forming a single pattern image. Thus, the secondary transfer roller 5 separates from the intermediate transfer belt 11 when a leading pattern image on the intermediate transfer belt 11 reaches a position right before the secondary transfer roller 5, to eliminate a waste of time.

By changing the separating timing, images or pattern images are unaffected by an impact of the secondary transfer roller 5. Accordingly, the image forming apparatus 100 can employ the secondary transfer roller 5 that emits less ozone compared to a discharge corotron. Thus, the overall size and downtime of the image forming apparatus 100 is reduced, and sufficient printing productivity is achieved.

Figure 15:
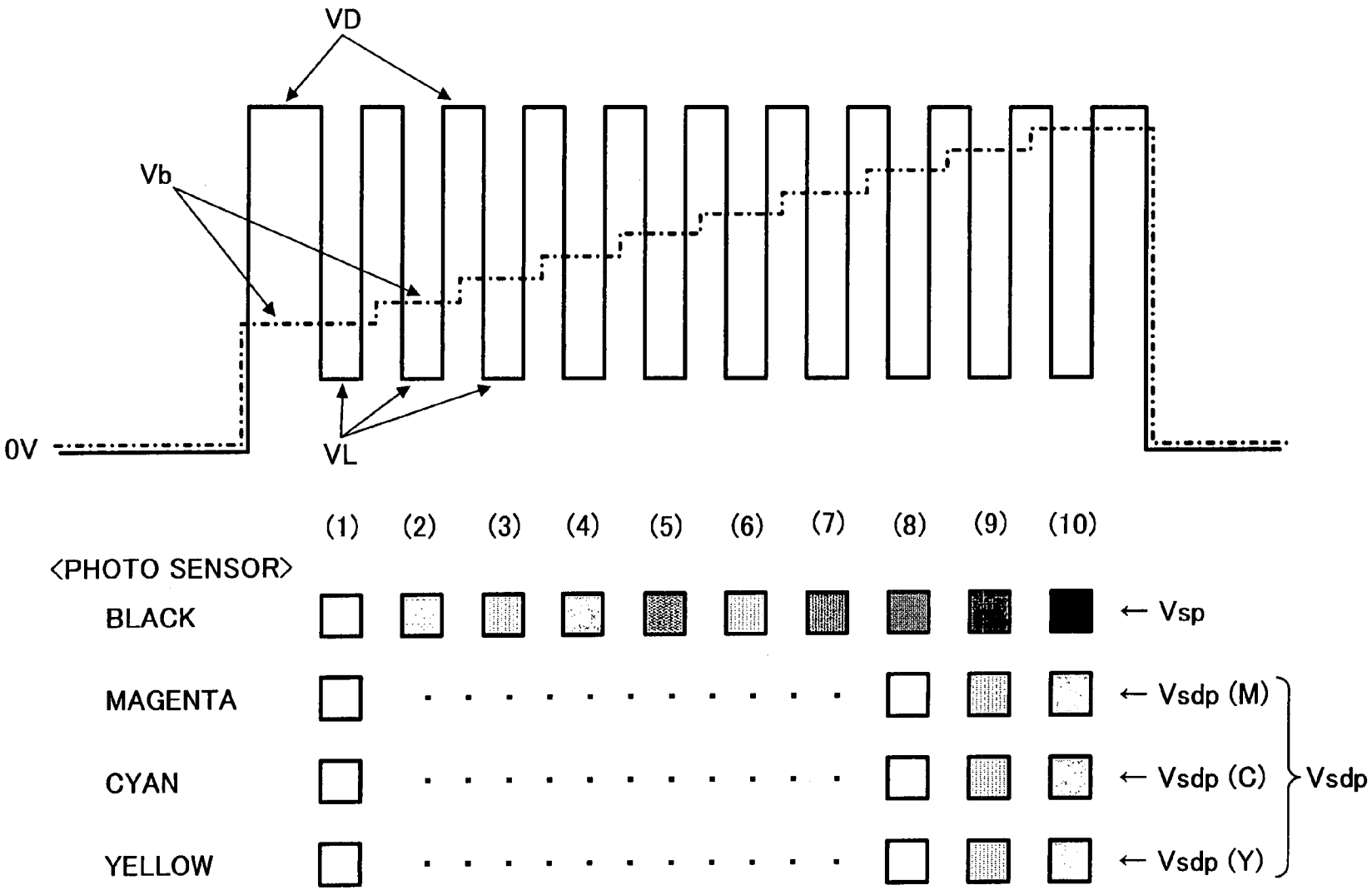
FIG. 15 is a schematic of a pattern block including pattern images of different densities formed by gradually changing a developing bias voltage.
Figure 16:
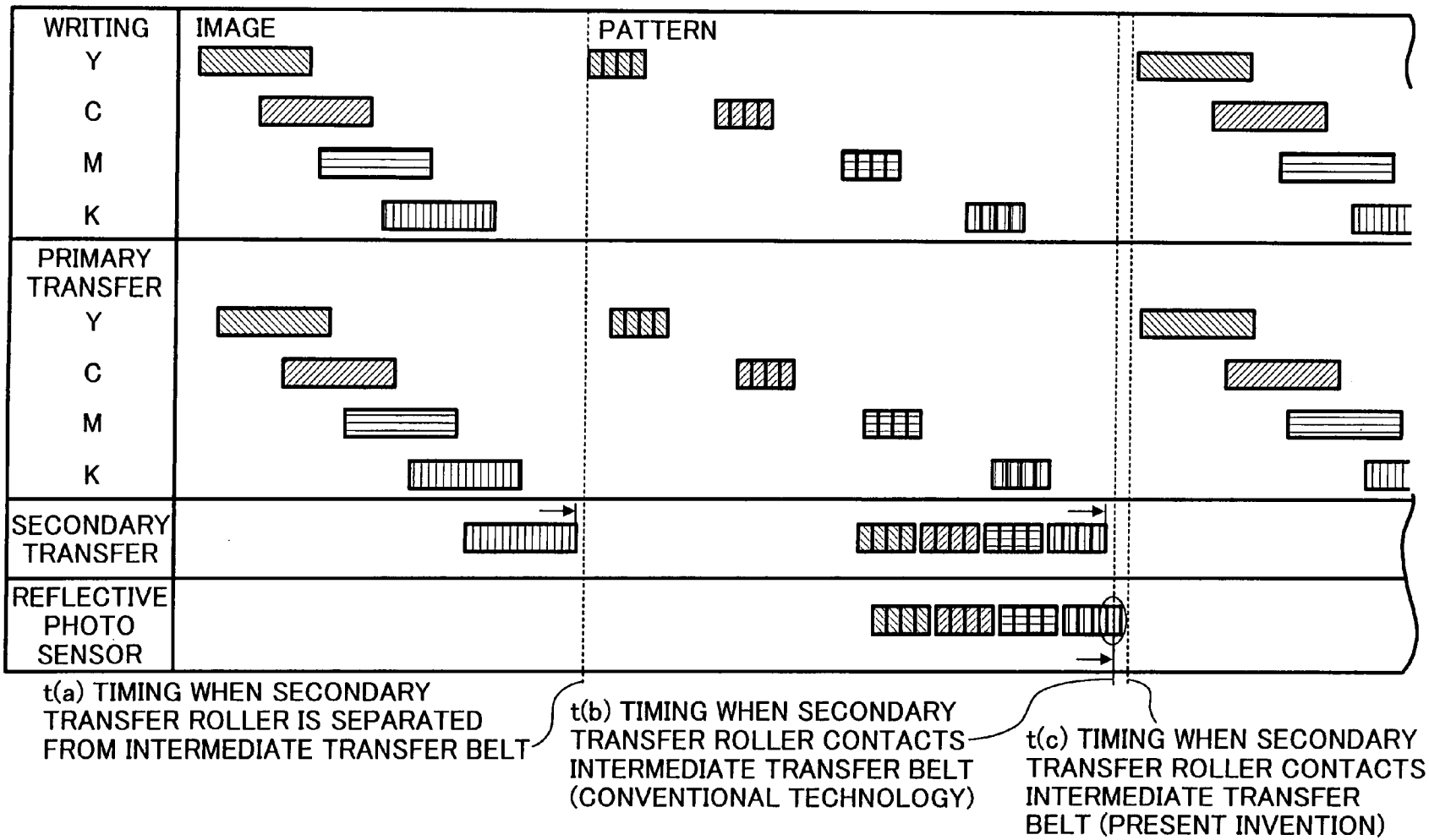
FIG. 16 a timing chart of a conventional image forming processing for forming pattern images.

FIG. 15 is a schematic of a pattern block including more than one pattern image of different densities that are formed by gradually changing a developing bias voltage. It takes a long time for all of these pattern images to be formed and detected. When primary transfer processes for all of the pattern images are not yet completed when a leading pattern image reaches the secondary transfer position, the timing at which the secondary transfer roller 5 separates from the intermediate transfer belt 11 is changed from that in the case of forming a single image.

For example, the secondary transfer roller 5 separates from the intermediate transfer belt 11 when a leading pattern image reaches a position right before the secondary transfer roller 5. However, when the secondary transfer roller 5 is separated while a pattern image is in a writing process or a transferring process, the corresponding pattern image is affected by an impact of the separating action. In this case, detection signals of the corresponding pattern image are excluded from conditions of the process control.

Moreover, a writing process is omitted so as not to form an electrostatic latent image during the separating action of the secondary transfer roller 5. Accordingly, toner consumption can be saved, and load on the intermediate transfer belt 11 and the intermediate-transfer-belt cleaning device 13 can be reduced.

According to the present embodiment, when image patterns are formed between regular images, an image adjustment operation can be performed within minimum time. Moreover, the reflective photo sensor 111 is located in a large space beyond the secondary transfer position, and image patterns are formed within a limited length, so that a distance between the primary transfer position and the secondary transfer position is reduced. This reduces time for printing out regular images.

The process control includes a toner replenishing control and a potential control. A toner replenishing time is calculated from: toner density signals that are output from the reflective photo sensor 111; a toner-density-control reference value; and pixel detection data. Subsequently, a toner replenishing motor is driven to replenish toner appropriately.

As shown in FIG. 15, latent image patterns of different colors are formed on the corresponding photosensitive element 20Y, 20M, 20C, and 20Bk with a predetermined charging voltage and laser diode (LD) power. A charging potential is denoted by VD and a potential of the LD exposing part is denoted by VL. A developing bias voltage Vb is gradually changed to form a plurality of pattern images of different densities (1) to (10). These pattern images are transferred on the intermediate transfer belt 11. Reflective photo sensors corresponding to each color detect the pattern images, and output signals (Vsdp(Y), Vsdp(C), Vsdp(M), Vsp). Developing input/output properties for each color are obtained as target properties from the signals. The control unit 110 changes the developing bias voltage Vb to achieve the target properties.

According to the present embodiment, the separating timing of the secondary transfer roller 5 can be changed, according to a type of image forming operation and a type of pattern image. Thus, an image adjustment operation can be performed with high accuracy, and time for performing the image adjustment operation can be minimized.

According to the present embodiment, the separating timing of the secondary transfer roller 5 can be changed according to whether a single pattern image is formed, or plural pattern images are formed by gradually changing an amount of toner adherence. Thus, a level of accuracy and a length of time for performing an image adjustment operation can be changed appropriately.

According to the present embodiment, detection signals of a pattern image that is affected by an impact caused by the separating action and the contacting action of the secondary transfer roller 5 are excluded from conditions of an image adjustment operation, so that an influence of the impact is cancelled out. Thus, the image adjustment operation can be performed accurately within short time, without increasing the overall size of the image forming apparatus 100.

According to the present embodiment, a writing process, a developing process, or a primary transfer process is not performed at the separating timing of the secondary transfer roller 5, so that an influence of the impact is cancelled out. Thus, toner consumption can be saved, and the image adjustment operation can be performed accurately within short time, without increasing the overall size of the image forming apparatus 100.

The present invention is not limited to these embodiments. Various modifications can be made by those skilled in the art without departing from the spirits of the invention.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A device for detecting image information, comprising:

an intermediate transfer member configured to hold a pattern image;

a detecting unit configured to optically detect the pattern image;

a secondary transfer unit configured to contact with and separate from the intermediate transfer member; and a control unit that controls the secondary transfer unit in such a manner that the secondary transfer unit does not contact the intermediate transfer member while the detecting unit is detecting the pattern image, and that controls the secondary transfer unit in such a manner that the secondary transfer unit contacts the intermediate transfer member after the detecting unit finishes detection of the pattern image.

2. The device according to claim 1, wherein the pattern image includes a plurality of pattern images, and a regular image is formed between adjacent pattern images.

3. The device according to claim 1, wherein the secondary transfer unit includes a roller, the intermediate transfer member includes a belt that is wound around a backup roller at a winding angle of at least 90 degrees, the backup roller arranged in such a manner that an axis of the backup roller is parallel to an axis of the secondary transfer unit, and the detecting unit is arranged downstream of rotation of the intermediate transfer member to the secondary transfer unit in a range that has a center at a point at which the intermediate transfer member separates from the backup roller and has a length equal to twice a radius of the secondary transfer unit.

4. The device according to claim 1, wherein any one of a writing process, a developing process, and a transferring process for forming the pattern image is not performed while the control unit is controlling the secondary transfer unit to separate from and contact with the intermediate transfer member.

5. The device according to claim 1, wherein the pattern image is formed within a period of time during the control unit controls the secondary transfer unit to separate from and contact with the intermediate transfer member for a single time, and a total length of the pattern image is shorter than a distance in a length direction of the intermediate transfer member, the distance between a position at which the pattern image is formed and a position of the secondary transfer unit.

6. The device according to claim 1, wherein the detecting unit detects the pattern image during a standby period for an image forming processing.

7. The device according to claim 1, wherein the pattern image includes a plurality of pattern images, the pattern images are arranged in any one of a length direction of the intermediate transfer member and a direction perpendicular to the length direction, and the detecting unit is arranged according to an arrangement of the pattern images.

8. An image forming apparatus comprising a device for detecting image information that includes an intermediate transfer member configured to hold a pattern image;

a detecting unit configured to optically detect the pattern image;

a secondary transfer unit configured to contact with and separate from the intermediate transfer member; and a control unit that controls the secondary transfer unit in such a manner that the secondary transfer unit does not contact the intermediate transfer member while the detecting unit is detecting the pattern image, and that controls the secondary transfer unit in such a manner that the secondary transfer unit contacts the intermediate transfer member after the detecting unit finishes detection of the pattern image.

9. The image forming apparatus according to claim 8, further comprising a image-formation control unit that determines an image forming sequence and a result of detection of the pattern images, wherein the pattern image includes a plurality of pattern images, and the image-formation control unit determines an order in which the pattern images are formed and timing at which an image is transferred onto a transfer medium.

10. An image forming apparatus comprising:

an intermediate transfer member configured to hold a toner image and a pattern image;

a secondary transfer unit configured to contact with and separate from the intermediate transfer member;

a detecting unit configured to optically detect an amount of toner adhering to the pattern image to obtain a value, the detecting unit arranged downstream of rotation of the intermediate transfer member to the secondary transfer unit, the pattern image formed in a region in which a regular image is not formed; and a control unit that controls any one of an image forming condition and an amount of toner to be replenished depending on the value, wherein the control unit further controls separating timing at which the secondary transfer unit separates from the intermediate transfer member and contacting timing at which the secondary transfer unit contacts with the intermediate transfer member, according to a type of image forming operation.

11. The image forming apparatus according to claim 10, wherein the control unit controls the separating timing according to a type of the pattern image.

12. The image forming apparatus according to claim 11, wherein the control unit controls the separating timing depending on whether a single pattern image is formed or a plurality of pattern images are formed.

13. The image forming apparatus according to claim 10, wherein the pattern image includes a plurality of pattern images successively arranged in a length direction of the intermediate transfer member, the pattern images are formed by a writing process, a developing process, and a transferring process, and if the secondary transfer unit separates from the intermediate transfer member while a pattern image is in any one of the writing process, the developing process, and the transferring process, a value of the pattern image obtained by the detecting unit is cancelled out.

14. The image forming apparatus according to claim 10, wherein the pattern image includes a plurality of pattern images successively arranged in a length direction of the intermediate transfer member, the pattern images are formed by a writing process, a developing process, and a transferring process, and any one of the writing process, the developing process, and the transferring process is not performed at the separating timing.

15. An image forming apparatus comprising:

an image forming station that includes an image carrier configured to hold a toner image and a pattern image;

an intermediate transfer member on which the toner image is transferred, a secondary transfer unit configured to contact with and separate from the intermediate transfer member;

a detecting unit configured to optically detect an amount of toner adhering to the pattern image to obtain a value, the detecting unit arranged downstream of rotation of the intermediate transfer member to the secondary transfer unit, the pattern image formed in a region in which a regular image is not formed; and a control unit that controls any one of an image forming condition and an amount of toner to be replenished depending on the value, wherein the control unit further controls separating timing at which the secondary transfer unit separates from the intermediate transfer member and contacting timing at which the secondary transfer unit contacts with the intermediate transfer member, according to a type of image forming operation.

16. The image forming apparatus according to claim 15, wherein the control unit controls the separating timing according to a type of the pattern image.

17. The image forming apparatus according to claim 16, wherein the control unit controls the separating timing depending on whether a single pattern image is formed or a plurality of pattern images are formed.

18. The image forming apparatus according to claim 15, wherein the pattern image includes a plurality of pattern images successively arranged in a length direction of the intermediate transfer member, the pattern images are formed by a writing process, a developing process, and a transferring process, and if the secondary transfer unit separates from the intermediate transfer member while a pattern image is in any one of the writing process, the developing process, and the transferring process, a value of the pattern image obtained by the detecting unit is cancelled out.

19. The image forming apparatus according to claim 15, wherein the pattern image includes a plurality of pattern images successively arranged in a length direction of the intermediate transfer member, the pattern images are formed by a writing process, a developing process, and a transferring process, and any one of the writing process, the developing process, and the transferring process is not performed at the separating timing.

* * * * *